US008804987B2

(12) United States Patent
Lee

(10) Patent No.: US 8,804,987 B2
(45) Date of Patent: Aug. 12, 2014

(54) HAT WITH SOUND PLAYING FUNCTION

(75) Inventor: Fang Ching Lee, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 784 days.

(21) Appl. No.: 12/905,740

(22) Filed: Oct. 15, 2010

(65) Prior Publication Data

US 2011/0088143 A1 Apr. 21, 2011

(30) Foreign Application Priority Data

Oct. 16, 2009 (TW) ..... 98135220 A

(51) Int. Cl.
*A42B 1/24* (2006.01)

(52) U.S. Cl.
USPC ..... 381/301; 381/388; 2/175.1

(58) Field of Classification Search
USPC ..... 381/301, 388, 333; 2/209, 171, 175.5, 2/175.1
See application file for complete search history.

(56) References Cited

U.S. PATENT DOCUMENTS

| | | | | |
|---|---|---|---|---|
| 3,612,778 | A | 10/1971 | Murphy | |
| 4,525,878 | A * | 7/1985 | Lowe, Jr. | 2/209.13 |
| 5,265,165 | A * | 11/1993 | Rauch | 381/309 |
| 5,881,160 | A | 3/1999 | Sheppard | |
| 6,305,026 | B1 | 10/2001 | Mo | |
| 6,370,696 | B1 * | 4/2002 | Kronenberger | 2/175.1 |
| 7,044,615 | B2 | 5/2006 | Gesten | |
| 7,950,068 | B2 * | 5/2011 | Chang | 2/195.2 |
| 8,139,794 | B2 | 3/2012 | Chen et al. | |
| 8,385,586 | B2 * | 2/2013 | Liou et al. | 381/431 |
| 2002/0186180 | A1 * | 12/2002 | Duda | 345/8 |
| 2004/0180691 | A1 | 9/2004 | Cascone | |
| 2007/0072655 | A1 | 3/2007 | Cascone | |
| 2007/0171628 | A1 | 7/2007 | Seade | |
| 2007/0242842 | A1 | 10/2007 | Kim | |
| 2008/0263750 | A1 | 10/2008 | Chen et al. | |
| 2008/0304682 | A1 | 12/2008 | Seade | |
| 2009/0060234 | A1 * | 3/2009 | Liou et al. | 381/191 |
| 2009/0172866 | A1 * | 7/2009 | Chang | 2/209.12 |
| 2011/0116673 | A1 * | 5/2011 | Lewis | 381/376 |

FOREIGN PATENT DOCUMENTS

| | | | |
|---|---|---|---|
| CN | 2840725 | | 11/2006 |
| CN | 201097667 | | 8/2008 |
| CN | 201175002 | | 1/2009 |
| EP | 2150075 | A2 | 2/2010 |
| GB | 2268043 | A | 1/1994 |
| JP | 2002291084 | A | 10/2002 |
| JP | 2007110382 | A | 4/2007 |
| TW | 1264960 | | 12/1993 |
| TW | M291221 | | 6/2006 |
| TW | M306788 | A | 3/2007 |
| TW | I293233 | | 2/2008 |
| TW | M329351 | | 4/2008 |
| TW | 200913753 | | 3/2009 |

* cited by examiner

*Primary Examiner* — Davetta W Goins
*Assistant Examiner* — Oyesola C Ojo
(74) *Attorney, Agent, or Firm* — Lowe Hauptman & Ham, LLP

(57) ABSTRACT

A hat with sound playing function includes a hat body, a brim extending from the hat body and at least one slim speaker. The brim has a supporting layer and a decorating layer covering a surface of the supporting layer. The at least one slim speaker is disposed between the supporting layer and the decorating layer.

19 Claims, 5 Drawing Sheets

HAT WITH SOUND PLAYING FUNCTION

CROSS REFERENCE TO RELATED APPLICATION

This application claims the priority benefit of Taiwan Patent Application Serial Number 098135220 filed Oct. 19, 2009, the full disclosure of which is incorporated herein by reference.

BACKGROUND OF THE INVENTION

1. Field of the Invention

The disclosure relates to a hat, and more particularly, to a hat with sound playing function.

2. Description of the Related Art

Conventional earphones have the advantages of small profile and high portability. However, a long-time use of earphones will damage the hearing and hurt the ears of users. Furthermore, since the earphones may drown out the ambient noise when being worn, the users will not notice outside noises that would typically warn of potential danger. Consequently, this may result in life threatening accidents.

In order to solve the above problems, U.S. Pat. No. 7,044,615 discloses a hat with audio assembly. The hat has an opening formed on the brim and the audio assembly comprising speakers, batteries, driving circuits and other electronic elements is arranged in the opening. In this manner a user may still listen to the music outdoors by wearing the above hat without the need of earphone.

However, the audio assembly of the above hat is arranged in the opening of the brim. This is not beautiful and the audio assembly will also be prone to vibrating on the brim. Furthermore, the above hat uses dynamic speakers, they are bulky and heavy. When the dynamic speakers together with the batteries and driving circuits are mounted on the brim, the brim will become heavy. As a result, the brim of the above hat will incline down to obstruct the sight of the wearer when the hat is worn.

SUMMARY OF THE INVENTION

A hat with sound playing function according to the present disclosure is provided.

In one embodiment, the hat with sound playing function according to the present disclosure includes a hat body, a brim and at least one slim speaker. The brim extends from the hat body and has a supporting layer and a decorating layer covering a surface of the supporting layer. The at least one slim speaker is disposed between the supporting layer and the decorating layer.

According to the hat of the present disclosure, the at least one slim speaker may be a capacitive speaker or a piezoelectric speaker. In this embodiment, the capacitive speaker includes a conductive plate, an electret diaphragm and a plurality of spacers. The conductive plate has a plurality of through openings. The electret diaphragm is disposed on a lower surface of the conductive plate and has a film body and an electrode layer, wherein the film body has static charges and the electrode layer is formed on a lower surface of the film body. The spacers are disposed between an upper surface of the film body and the conductive plate.

According to the hat of the present disclosure, the at least one slim speaker comprises two speakers configured to play left and right channel audio signals outputted from a sound source, respectively.

In addition, the hat of the present disclosure further includes a driving circuit, a wireless signal transceiving module and a control element. The driving circuit is configured to drive the at least one slim speaker. The wireless signal transceiving module is configured to receive an audio signal from an external electronic device and then transmit the audio signal to the at least one slim speaker through the driving circuit so that the at least one slim speaker may play the audio signal. The control element is configured to transmit a wireless control signal to the external electronic device through the wireless signal transceiving module.

The foregoing, as well as additional objects, features and advantages of the disclosure will be more readily apparent from the following detailed description, which proceeds with reference to the accompanying drawings.

DETAILED DESCRIPTION OF THE PREFERRED EMBODIMENT

Figure 1:
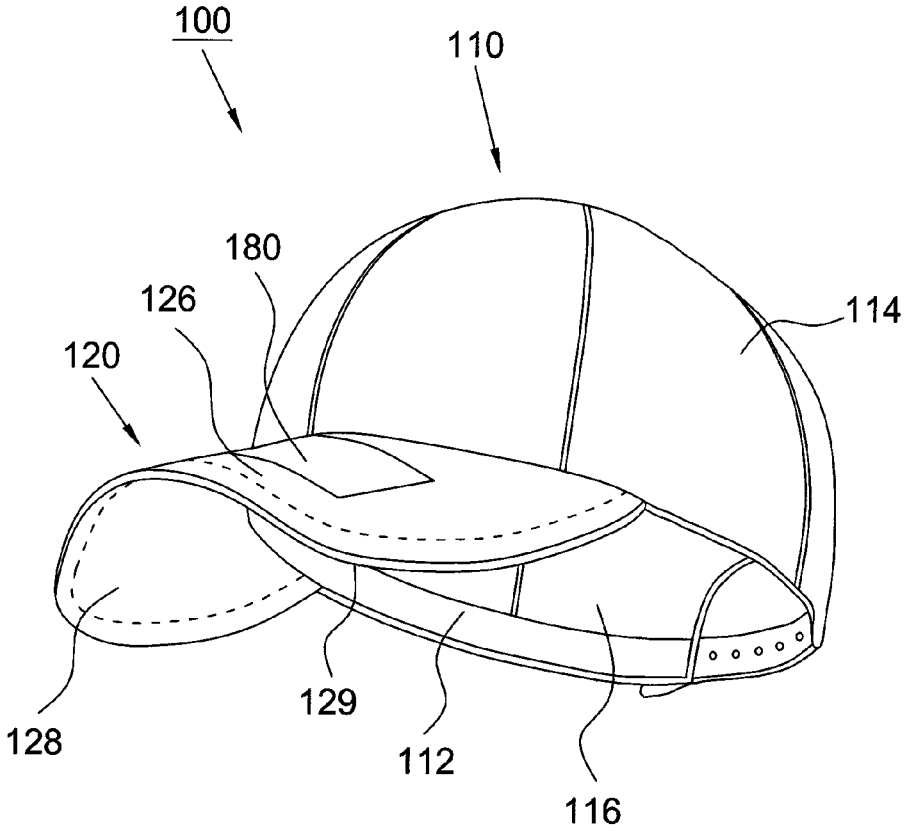
FIG. 1 is a perspective view of the hat of the present disclosure.
Figure 2:
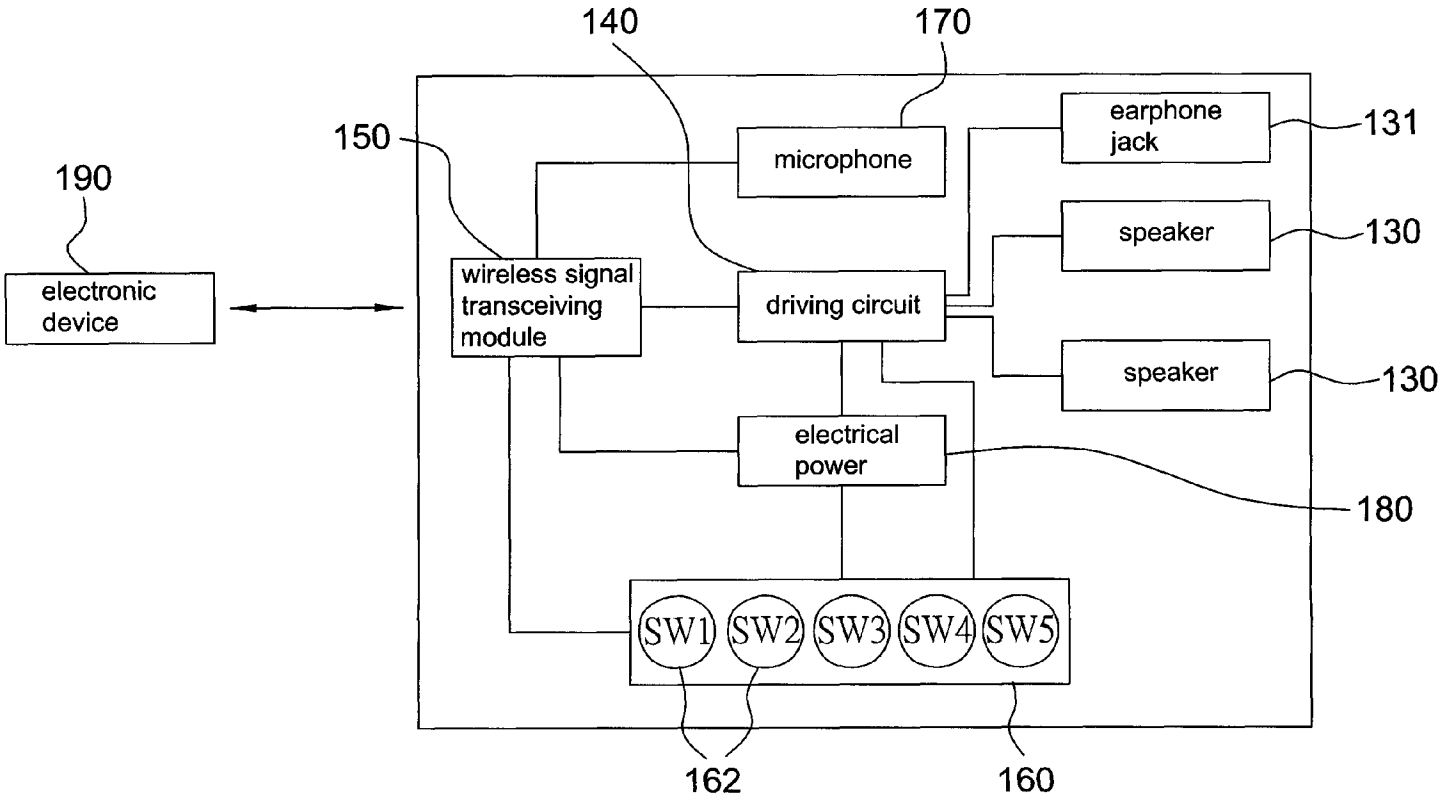
FIG. 2 is a block diagram showing the electronic elements of the hat of the present disclosure.
Figure 5:
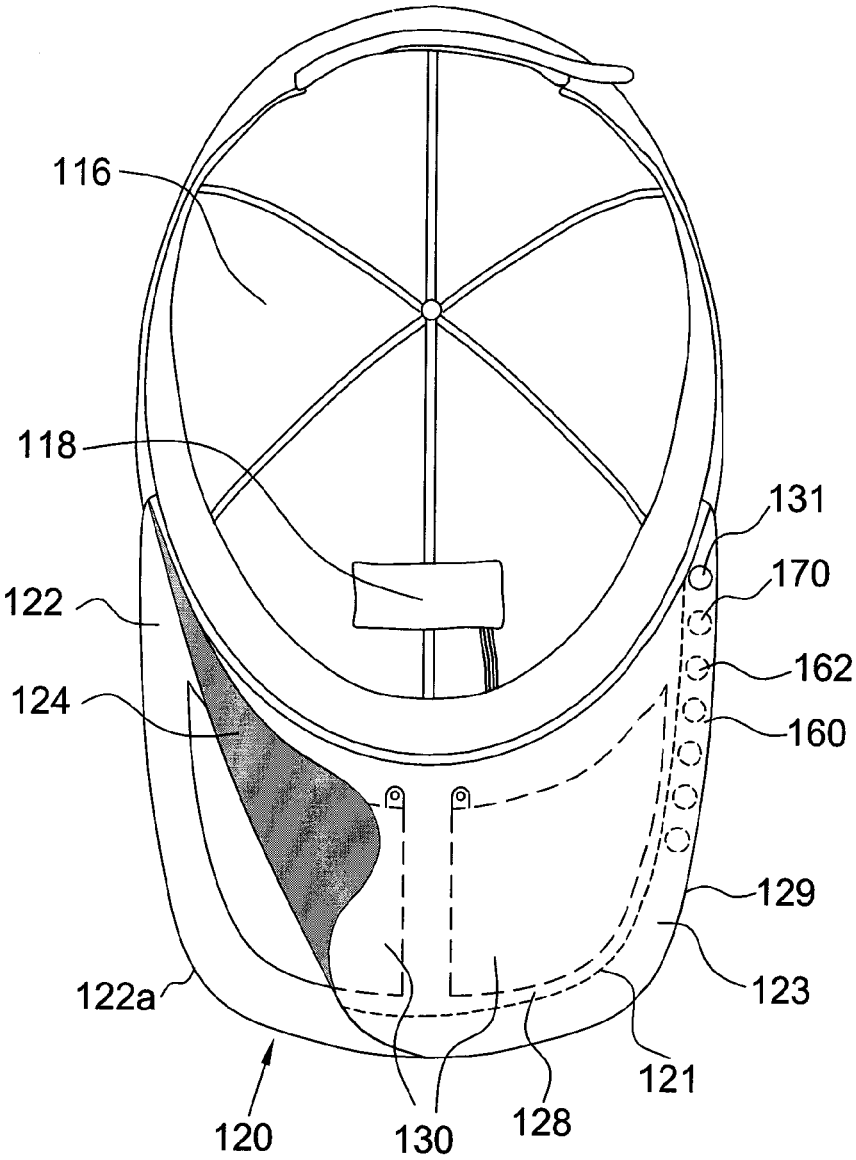
FIG. 5 is a bottom view of the hat of the present disclosure.

Referring to FIGS. 1, 2 and 5, the hat 100 with sound playing function according to the present disclosure includes a hat body 110, a brim 120 and at least one slim speaker 130. The hat body 110 is configured to be worn on a user's head and has an opening 112, an outer surface 114 and an inner surface 116. When a user wears the hat body 110 on his/her head through the opening 112, the inner surface 116 will be in contact with the head and the outer surface 114 will be exposed out. The brim 120 is sheet-shaped and extends from a portion of the edge of the hat body 110. In other embodiments, the brim 120 may be annular and extends from the entire edge of the hat body 110.

Referring to FIG. 2, the hat 100 further includes a driving circuit 140, a wireless signal transceiving module 150, a control element 160, a microphone 170 and an electrical power 180. The wireless signal transceiving module 150 is configured to wirelessly transmit a wireless signal to an external electronic device 190 or to receive a wireless signal from the external electronic device 190. In this disclosure, the wireless signal transceiving module 150 may be a Bluetooth module or a Wi-Fi module. The driving circuit 140 is electrically connected to the at least one speaker 130 to drive the at least one speaker 130 to play sound. In addition, the driving circuit 140 is also electrically connected to the wireless signal transceiving module 150 so as to receive from the external electronic device 190 an audio signal, such as a voice data signal or a music data signal through the wireless signal transceiving module 150. The wireless signal transceiving module 150 may wirelessly receive an audio signal from the external electronic device 190 and then transmit the audio signal to the driving circuit 140. Afterward, the driving circuit 140 transmits the audio signal to the at least one speaker 130 to have the at least one speaker 130 play the audio signal. The microphone 170 is electrically connected to the wireless signal transceiving module 150 and configured to generate a voice data signal and then transmit it to the external electronic device 190 through the wireless signal transceiving module 150. With such design the microphone 170 may be configured for a wearer to make a voice communication when the electronic device 190 is a telephone. The control element 160 is electrically connected to the driving circuit 140, wireless signal transceiving module 150 and electrical power 180. The control element 160 has a plurality of push-button switches 162 that may switch on or off the electrical power supply to the driving circuit 140 so as to power up or down the at least one speaker 130 to begin or stop the playing of the audio signal. Further, the control element 160 may be configured to control the driving circuit 140 to adjust the volume of the at least one speaker 130. In addition, the control element 160 may also transmit a wireless control signal to the external electronic device 190 through the wireless signal transceiving module 150 thereby controlling the electronic device 190. For example, the switches 162 may be used to wirelessly manipulate a multimedia program executed in the electronic device 190, such as play music, stop playing music, select music to play or adjust music volume. The electrical power 180 is also electrically connected to the driving circuit 140 so as to supply power to the at least one speaker 130. In this embodiment, the electrical power 180 may be common batteries or solar cells. Additionally, the external electronic device 190 may be a mobile phone, smart phone, personal digital assistant phone (PDA), MP3 player or one with the function of playing music or voice. In other embodiments, the hat 100 further includes an earphone jack 131 electrically connected to the driving circuit 140 so that an audio signal outputted from a sound source, such as the external electronic device 190 may be wiredly transmitted to the hat 100 to be played through the earphone jack 131.

According to the present disclosure, the at least one speaker 130 is positioned on the brim 120. Preferably, the hat 100 includes two speakers 130 configured to play left and right channel audio signals outputted from a sound source, such as the external electronic device 190, respectively. In this disclosure, the at least one speaker 130 may be a piezoelectric speaker or a flexible capacitive speaker.

Figure 3:
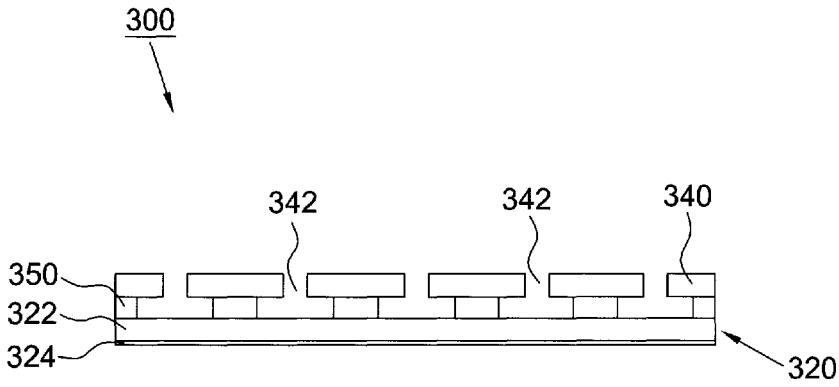
FIG. 3 is a cross-sectional view of the single-diaphragm speaker of the hat of the present disclosure.

When the speaker 130 is a flexible capacitive speaker, it may be the single-diaphragm speaker 300 of FIG. 3. The speaker 300 includes a flexible conductive plate 340 functioning as an electrode. The conductive plate 340 has a plurality of through openings 342 and may be a metal plate or transparent conductive film. An electret diaphragm 320 is disposed on the lower surface of the conductive plate 340 and includes a film body 322 and an electrode layer 324 formed on the lower surface of the film body 322. The film body 322 is made of dielectric material and has static charge. The speaker 300 further includes a plurality of spacers 350 that are disposed between the upper surface of the film body 322 and the conductive plate 340 to keep a predetermined distance between the electret diaphragm 320 and the conductive plate 340.

To have the speaker 300 work, the driving circuit 140 has to apply electrical signals having the same phase and opposite phase with the original sound signal, i.e. differential signals to the conductive plate 340 and electrode layer 324, respectively so that the electret diaphragm 320 is subject to the Coulomb forces from the conductive plate 340 and electrode layer 324 to bring about a push-pull effect. The push-pull effect will cause the electret diaphragm 320 to vibrate in accordance with the electrical signals. The vibration of the electret diaphragm 320 pushes the air to make sounds.

Figure 4:
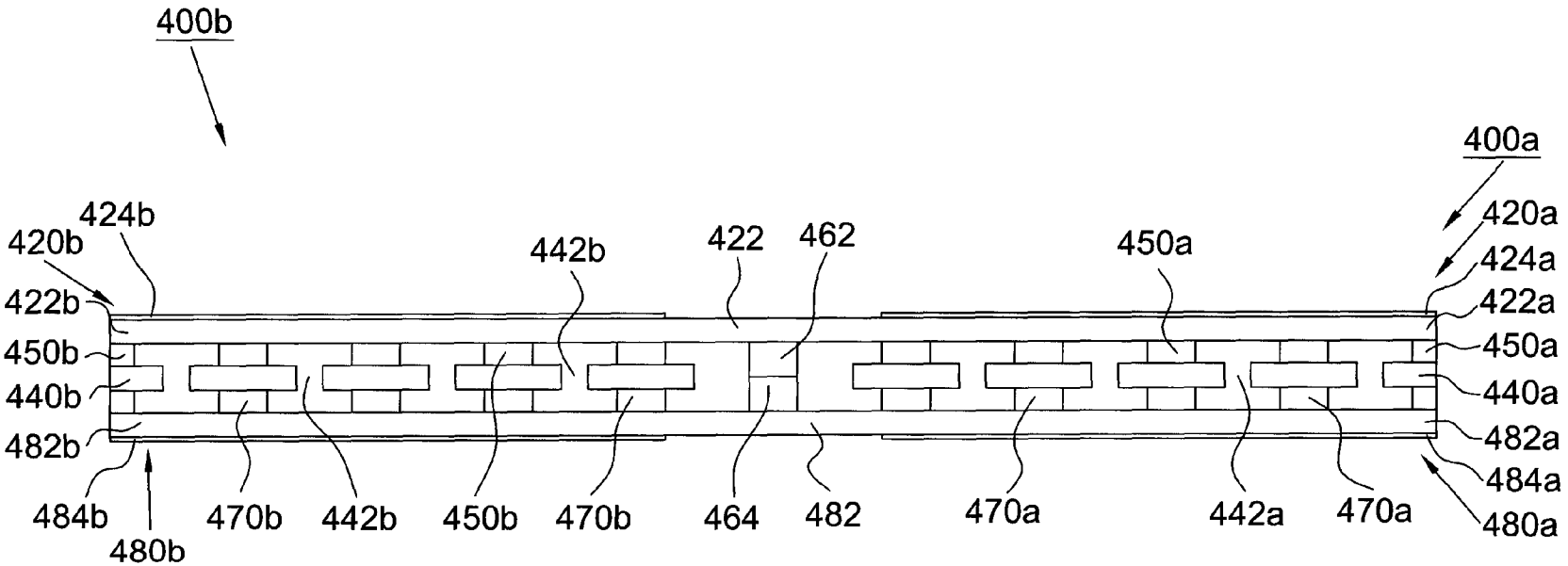
FIG. 4 is a cross-sectional view of the double-diaphragms speakers of the hat of the present disclosure.

According to the present disclosure, when the hat 100 includes two the speakers 130 disposed on the brim 120, the speakers 130 may be the double-diaphragms speakers 400*a* and 400*b* of FIG. 4. The speaker 400*a* include a flexible conductive plate 440*a* functioning as an electrode. The conductive plate 440*a* has a plurality of through openings 442*a* and is made of a metal plate. An electret diaphragm 420*a* is stacked on the conductive plate 440*a* and includes a film body 422*a* and an electrode layer 424*a* formed on the upper surface of the film body 422*a*. The film body 422*a* is made of dielectric material and has static charge. A plurality of spacers 450*a* is disposed between the lower surface of the film body 422*a* and the conductive plate 440*a* to keep a predetermined distance between the electret diaphragm 420*a* and the conductive plate 440*a*. In addition, an electret diaphragm 480*a* is disposed on the lower surface of the conductive plate 440*a* and includes a film body 482*a* and an electrode layer 484*a* formed on the lower surface of the film body 482*a*. The film body 482*a* is made of dielectric material and has static charge. A plurality of spacers 470*a* is disposed between the upper surface of the film body 482*a* and the conductive plate 440*a* to keep a predetermined distance between the electret diaphragm 480*a* and the conductive plate 440*a*. About the speaker 400*b*, it includes a flexible conductive plate 440*b*, an electret diaphragm 420*b* comprising a film body 422*b* and an electrode layer 424*b*, a plurality of spacers 450*b*, an electret diaphragm 480*b* comprising a film body 482*b* and an electrode layer 484*b*, and a plurality of spacers 470*b*. These elements have the arrangements and functions that are the same as the arrangements and functions of the flexible conductive plate 440*a*, electret diaphragm 420*a*, spacers 450*a*, electret diaphragm 480*a* and spacers 470*a*, respectively. Thus, any further illustrations of these elements are omitted herein.

To have the speaker 400*a* work, the driving circuit 140 has to apply first electrical signals having the same phases to the electrode layers 424*a* and 484*a*, respectively. The conductive plate 440*a* is grounded or applied a second electrical signal having the phase opposite to that of the first electrical signal by the driving circuit 140. Similarly, the driving circuit 140 has to apply third electrical signals having the same phases to the electrode layers 424*b* and 484*b*, respectively. The conductive plate 440*b* is grounded or applied a fourth electrical signal having the phase opposite to that of the third electrical signal by the driving circuit 140. The double-diaphragm speakers in this embodiment are also described in commonly-owned and copending Taiwan patent application serial number 098116129 filed May 15, 2009, entitled "ELECTRONIC DEVICE AND ELECTRO-ACOUSTIC TRANSDUCER THEREOF". The double-diaphragm speakers disclosed in the above application is incorporated herein by reference.

In this embodiment, the film bodies 422*a*, 422*b* of the electret diaphragms 420*a*, 420*b* may be integrally formed. Specifically, the film bodies 422*a*, 422*b* are made of a same film 422. The electrode layers 424*a* and 424*b* are formed on the film 422 and electrically isolated from each other. Similarly, the film bodies 482*a*, 482*b* of the electret diaphragms 480*a*, 480*b* may also be integrally formed on a same film 482 and the electrode layers 484*a*, 484*b* are formed on the film 482 and electrically isolated from each other. In order to have the electret diaphragms 420*a* and 420*b* vibrate independently from each other and to have the electret diaphragms 480*a* and 480*b* vibrate independently from each other, a strip of adhesive material 462 attached to the film 422 is disposed between the film bodies 422*a* and 422*b*, and a strip of adhesive material 464 attached to the film 482 is disposed between the film bodies 482*a* and 482*b*. Then the two adhesive materials 462 and 464 are attached to each other. In this manner the electret diaphragms 420*a*, 420*b*, 480*a* and 480*b* may vibrate independently from each other. In this disclosure, the adhesive materials 462 and 464 may be double-sided tapes and that two double-sided tapes may be replaced with a thicker double-sided tape. In addition, the spacers 350, 450*a*, 450*b*, 470*a* and 470*b* are made of adhesive materials, such as double-sided tapes.

It is to be noted that other capacitive or piezoelectric speakers may also be used as the at least one speaker 130 of the present disclosure in addition to the above speakers 300, 400*a* and 400*b*.

Referring to FIGS. 1 and 5 again, FIG. 5 is a bottom view of the hat 100 of the present disclosure. In order to clearly show the structure of the brim 120 of the hat 100, a portion of a decorating layer 124 is lifted up to disclose a portion of a supporting layer 122 and a portion of the at least one speaker 130. According to the hat 100 of the present disclosure, the brim 120 has an upper surface 126 and a lower surface 128, and a supporting layer 122 and a decorating layer 124. The decorating layer 124 may be made of cotton cloth or plastic material and covers an upper surface and a lower surface of the supporting layer 122. The supporting layer 122 is configured to keep the brim 120 to have a predetermined shape. The at least one speaker 130 is disposed on the lower surface 128 of the brim 120. For example, the at least one speaker 130 may be disposed between the supporting layer 122 and decorating layer 124 so that the at least one speaker 130 may be hidden in the brim 120. Furthermore, the switches 162 of the control element 160 are disposed on the lower surface 128 of the brim 120, for example, on the edge 129 of the brim 120 for a wearer to conveniently manipulate the switches 162 when the hat 100 is worn. Moreover, the microphone 170 is also disposed on the lower surface 128 of the brim 120, for example, on the edge 129 of the brim 120 near the hat body 110. Since that position is very close to the mouth of a wearer, the microphone 170 may receive clearly a voice from the wearer's mouth. It is to be noted that since the conductive plates of the capacitive speakers may be made of metal plates, the hat 100 of the present disclosure is not required to include the supporting layer 122. The conductive plate of the at least one speaker 130 may function as the supporting layer of the brim 120 to maintain a fixed shape of the brim 120.

To prevent the decorating layer 124 from separating from the supporting layer 122, the decorating layer 124 is stitched on the supporting layer 122 with stitches 121 near the edge 122*a* of the supporting layer 122. A narrow accommodating space 123 is therefore formed between the stitches 121 and the edge 122*a* of the supporting layer 122, and between the supporting layer 122 and decorating layer 124. The control element 160 and microphone 170 may be disposed in the accommodating space 123 to be fixed on the brim 120. This way the control element 160 and microphone 170 may be securely placed and therefore not move in the narrow accommodating space 123. It is to be noted that although the control element 160 and microphone 170 are covered by the decorating layer 124, the switches 162 may still be pushed and the voice from the wearer's mouth may still pass through the decorating layer 124 to arrive at and be received clearly by the microphone 170. Therefore, whether the decorating layer 124 is present or not will not give any influence on the manipulation of the switches 162 and the function of the microphone 170. The driving circuit 140, wireless signal transceiving module 150 and electrical power 180 may be arranged in the hat body 110, for example, on the inner surface 116 of the hat body 110 in such a manner that these elements are positioned corresponding to the forehead of a wearer when the hat 100 is worn. In order to have the above elements immovable in the hat body 110, an accommodating bag 118 is disposed on the inner surface 116 of the hat body 110 and corresponding to a wearer's forehead. The driving circuit 140, wireless signal transceiving module 150 and electrical power 180 are placed in the accommodating bag 118. If the electrical power 180 includes a solar cell, the solar cell may be disposed on the outer surface 114 of the hat body 110 and/or the upper surface 126 of the brim 120 so as to receive more light.

According to the hat of the present disclosure, it may be a golf hat, baseball hat or bicycle hat. A user may still listen to the music outdoors by simply wearing the hat of the present disclosure without the need of earphone. In addition, the wearer may further answer a phone call through the microphone of the hat. Since the speakers of the hat of the present disclosure are slim and may be attached to the brim, the hat of the present disclosure has an appearance similar to that of a common hat. In addition, since the slim speakers have less power consumption than conventional dynamic ones do, they may be continuously used for a long time without the need to change the battery. Finally, since the slim speakers are lightweight, the brim of the hat will not incline down to obstruct the sight of the wearer when the hat is worn.

Although the preferred embodiments of the disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A hat with sound playing function, the hat comprising:

a hat body;

a brim extending from the hat body and having a supporting layer and a decorating layer covering a surface of the supporting layer; and at least one slim speaker between the supporting layer and the decorating layer, the at least one slim speaker includes a capacitive double-diaphragm speaker comprising:

a conductive plate having a plurality of through openings;

a first electret diaphragm on a lower surface of the conductive plate, the first electret diaphragm having a first film body and a first electrode layer, wherein the first film body has static charges and the first electrode layer is formed on a lower surface of the first film body;

a plurality of first spacers between an upper surface of the first film body and the conductive plate;

a second electret diaphragm on an upper surface of the conductive plate, the second electret diaphragm having a second film body and a second electrode layer, wherein the second film body has static charges and the second electrode layer is formed on an upper surface of the second film body; and a plurality of second spacers between a lower surface of the second film body and the conductive plate.

2. The hat as claimed in claim 1, wherein the first spacers are made of double-sided tapes.

3. The hat as claimed in claim 1, wherein the conductive plate is a metal plate.

4. The hat as claimed in claim 1, wherein the at least one slim speaker comprises two speakers configured to play left and right channel audio signals outputted from a sound source, respectively.

5. The hat as claimed in claim 4, wherein the first film bodies of the first electret diaphragms of the two speakers are integrally formed.

6. The hat as claimed in claim 1, further comprising:

a driving circuit electrically connected to the at least one slim speaker, configured to drive the at least one slim speaker; and a wireless signal transceiving module electrically connected to the driving circuit, wherein the driving circuit is further configured to receive an audio signal from an external electronic device through the wireless signal transceiving module.

7. The hat as claimed in claim 6, further comprising:

an accommodating bag disposed on an inner surface of the hat body, wherein the driving circuit and the wireless signal transceiving module are disposed in the accommodating bag.

8. The hat as claimed in claim 7, wherein the accommodating bag is disposed corresponding to the forehead of a wearer.

9. The hat as claimed in claim 6, further comprising:

a control element electrically connected to the driving circuit and the wireless signal transceiving module, having at least one switch, wherein the control element is configured to transmit a wireless control signal to the external electronic device through the wireless signal transceiving module.

10. The hat as claimed in claim 9, wherein the switch of the control element is configured to wirelessly manipulate a multimedia program executed in the external electronic device.

11. The hat as claimed in claim 10, wherein the switch of the control element is further configured to play music, stop playing music, select music to play or adjust music volume.

12. The hat as claimed in claim 9, wherein the switch of the control element is disposed on the edge of the brim.

13. The hat as claimed in claim 12, wherein the decorating layer is stitched on the supporting layer, the switch of the control element is disposed in a space formed between the stitches and the edge of the supporting layer, and between the supporting layer and the decorating layer.

14. The hat as claimed in claim 6, further comprising:

a microphone electrically connected to the wireless signal transceiving module, configured to generate a voice data signal and transmit the voice data signal to the external electronic device through the wireless signal transceiving module.

15. The hat as claimed in claim 14, wherein the microphone is disposed on the edge of the brim.

16. The hat as claimed in claim 15, wherein the decorating layer is stitched on the supporting layer with stitches, the microphone is disposed in a space formed between the stitches and the edge of the supporting layer, and between the supporting layer and the decorating layer.

17. The hat as claimed in claim 6, further comprising:

a solar cell electrically connected to the driving circuit.

18. The hat as claimed in claim 17, wherein the solar cell is disposed on the brim.

19. The hat as claimed in claim 1, wherein the decorating layer is made of cotton cloth or plastic material.

* * * * *